United States Patent [19]

Zimmermann

[11] Patent Number: 4,657,035

[45] Date of Patent: Apr. 14, 1987

[54] DEVICE FOR SEPARATING SINGLE COINS

[75] Inventor: Gert Zimmermann, Berlin, Fed. Rep. of Germany

[73] Assignee: F. Zimmermann & Co., Fed. Rep. of Germany

[21] Appl. No.: 707,604

[22] Filed: Mar. 4, 1985

[30] Foreign Application Priority Data

Mar. 5, 1984 [DE] Fed. Rep. of Germany ..... 3408524

[51] Int. Cl.[4] ..... G07D 1/00

[52] U.S. Cl. ..... 133/5 R; 133/3 A; 133/3 R; 133/1 R

[58] Field of Search ..... 133/5 R, 3 A, 3 F, 3 H, 133/8 A, 8 D, 8 R, 3 R, 1 R, 3 C, 3 D, 3 E, 8 E

[56] References Cited

U.S. PATENT DOCUMENTS

| | | | |
|---|---|---|---|
| 1,279,351 | 9/1918 | Jorgensen et al. | 133/8 A |
| 4,167,949 | 9/1979 | Hashimoto et al. | 133/3 D |
| 4,480,651 | 11/1984 | Nakai et al. | 133/3 A |

FOREIGN PATENT DOCUMENTS

| | | |
|---|---|---|
| 2120353 | 4/1971 | Fed. Rep. of Germany . |
| 3021327 | 12/1981 | Fed. Rep. of Germany . |
| 2045502 | 10/1980 | United Kingdom . |

*Primary Examiner*—Joseph J. Rolla
*Assistant Examiner*—Jay I. Alexander
*Attorney, Agent, or Firm*—McGlew and Tuttle

[57] ABSTRACT

An improved device for separating out single coins from a collective plurality of coins solves the problem of separating stacked coins, namely two or three coins lying one upon the other with their total thickness being smaller than or equal to that of the thickest coin. In accordance with the device, to separate the coins, a second coin stripping arm (15) embodied by a narrow and thin guide finger (16) is provided downstream of a first coin stripper (14), considered in the direction of rotation (Arrow 5) of the coin disc (3), the first coin stripper (14) being adjusted to the thickness of the thickest coin, and the guide finger (16) projecting beyond the disc outer edge and guiding the respective underlying coins (11) on the coin disc (3) directly into a guideway (8) above which a first conveyor belt (12) is disposed. Another conveyor belt (18) extending parallel to the first conveyor belt (12) runs above the guide finger (16) and pulls off any overlying coins (11) which rest on those coins (11) which lie directly on the coin disc (3) thereby returning those overlying coins to the coin disc (3). The guide finger (16) co-operates with a crescent-shaped spring-biased pivot or ball closing element (25) by which the entrance (7) is opened at every instance only to an extent permitting a single coin to pass along the front edge (17) of the guide finger (16) into the guideway (8).

12 Claims, 6 Drawing Figures

DEVICE FOR SEPARATING SINGLE COINS

FIELD AND BACKGROUND OF THE INVENTION

The present invention relates to a device for separating single coins from a plurality of coins. The device is to be used at the occurrence of so called double coins, i.e. two or three thin coins lying one on the other, to push the upper coin or coins off the underlying one. Provided that the total thickness of the superposed coins is smaller than the thickness of the thickest coin, such double coins may pass below a first coin stripping arm. However, a second coin stripping arm must make sure that the individual coins of a double coin will be separated from each other.

In a separating device known from German Pat. No. 29 12 016, the second coin stripping arm is mounted above the coin disc for pivoting and is formed by two spring-biased arm parts. The second coin stripping arm is therefore costly in manufacture and, particularly, requires an expensive adjustment. The stripping arm must be designed individually for each collection of coins and adjusted thereto. Further, experience has shown that the second coin stripping arm readily undergoes wear and gets easily stuck.

Further known, from German Pat. No. 33 30 441, is a separating device comprising a second coin stripping arm formed in a row of balls which are resiliently mounted close above the coin disc. Such a row of balls again is expensive in manufactue and assemblage and must be adjusted individually to the coin thicknesses for each collection of coins.

Finally, a generically different device for separating coins is known from German Pat. No. 21 20 353, in which the coins are moved from the coin disc after the first coin stripping arm by means of a first conveyor belt and are directed against the guide rail of a guideway where they are taken over by a second conveyor belt associated with the guideway. Closely adjacent the coin disc, a shallow step is provided in the guide rail, having a height approximately corresponding to half the height of the thinnest coin. Immediately after the step, i.e. outside the guide rail, a discharge opening is provided. In this way, the coins lying above those directed against the guide rail can be sorted out outside the coin disc to the discharge opening. In this separating device, the double coins delivered to the discharge opening must again be returned to the coin disc, for separation. This means that double coins delivered from the discharge opening must recurrently be returned to the coin disc.

SUMMARY OF THE INVENTION

The present invention is directed to a development of a separating device of the mentioned kind to the effect that, at small costs and with constructional parts as simple in manufacture as possible, double coins can be separated on the coin disc and, particularly, that unsorted, mixed coins of a plurality of coin collectives, i.e. coins of unequal diameters and thicknesses, can undergo this process of separation.

The problem is solved in accordance with the characterizing features of the invention. A narrow and thin guide finger used in the invention is a component part easy to manufacture and simple to mount, which does not require adjustment and is reliable for the separation of double coins even in instances where unsorted mixed coins of different coin collectives, i.e. coins having unequal diameters and thicknesses, are to be treated. The narrow and thin guide finger guides the lowermost coin which reposes on a coin disc and slides therealong, into a guideway where the coin is taken over and moved farther by a conveyor belt there provided. All the other coins lying above the coin which abuts against the guide finger are pulled by a second conveyor belt disposed above the guide finger off the underlying coins and moved over and beyond the narrow and thin guide finger to the coin disc again.

In contradistinction to the prior art second coin stripping arms which are mounted above the coin disc in spaced-apart position and retain always the overlying coins and let them pass after the underlying ones or return them to the coin disc, the narrow and thin guide finger extending directly above the coin disc always deviates the lowermost coin and guides it to the entrance of the guideway, while the overlying coins are entrained in the direction of motion of the coin disc by the second conveyor belt mounted above the guide finger, and further conveyed on the coin disc.

This makes absolutely sure that no double coins will pass to the entrance of the guideway. The coins are separated directly on the coin disc, so that in comparison to prior art coin separating processes, an important advantage is obtained, namely that the coins need not be manually, or by means of particular mechanisms, returned from a discharge opening to the coin disc again.

The guide finger is thinner than the thinnest one of the coins, more particularly, its thickness is about 1 mm. The guide finger is made of a wear-resistant sheet steel of high strength. Preferably, the guide finger extends at an acute angle relative to the radius of the coin disc, in the direction of the entrance and is designed as an angled extension of the guide rail of the guideway. This facilitates the deviation of The coins by the guide finger from the coin disc, since the coins are at the same time fed to the guide rail of the guideway.

It is true that an extension of the guide rail protruding above the coin disc is known already from German Pat. No. 11 99 528. In that design, however, the guideway extends radially to the coin disc and the guide rail is intended only for deviating the coins from the coin disc and directing them into the radially adjacent guideway. Since with such a device, only coins of a single type, i.e. coins that are uniform in diameter and thickness, are counted, and no double coins can occur due to the adjustment of the first coin stripping arm to the thickness of the coin, the problem of a double coin does not arise.

BRIEF DESCRIPTION OF THE DRAWINGS

In the following, the invention is explained in more detail with reference to an embodiment shown in the drawings in which.

DESCRIPTION OF THE PREFERRED EMBODIMENT

Figure 1:
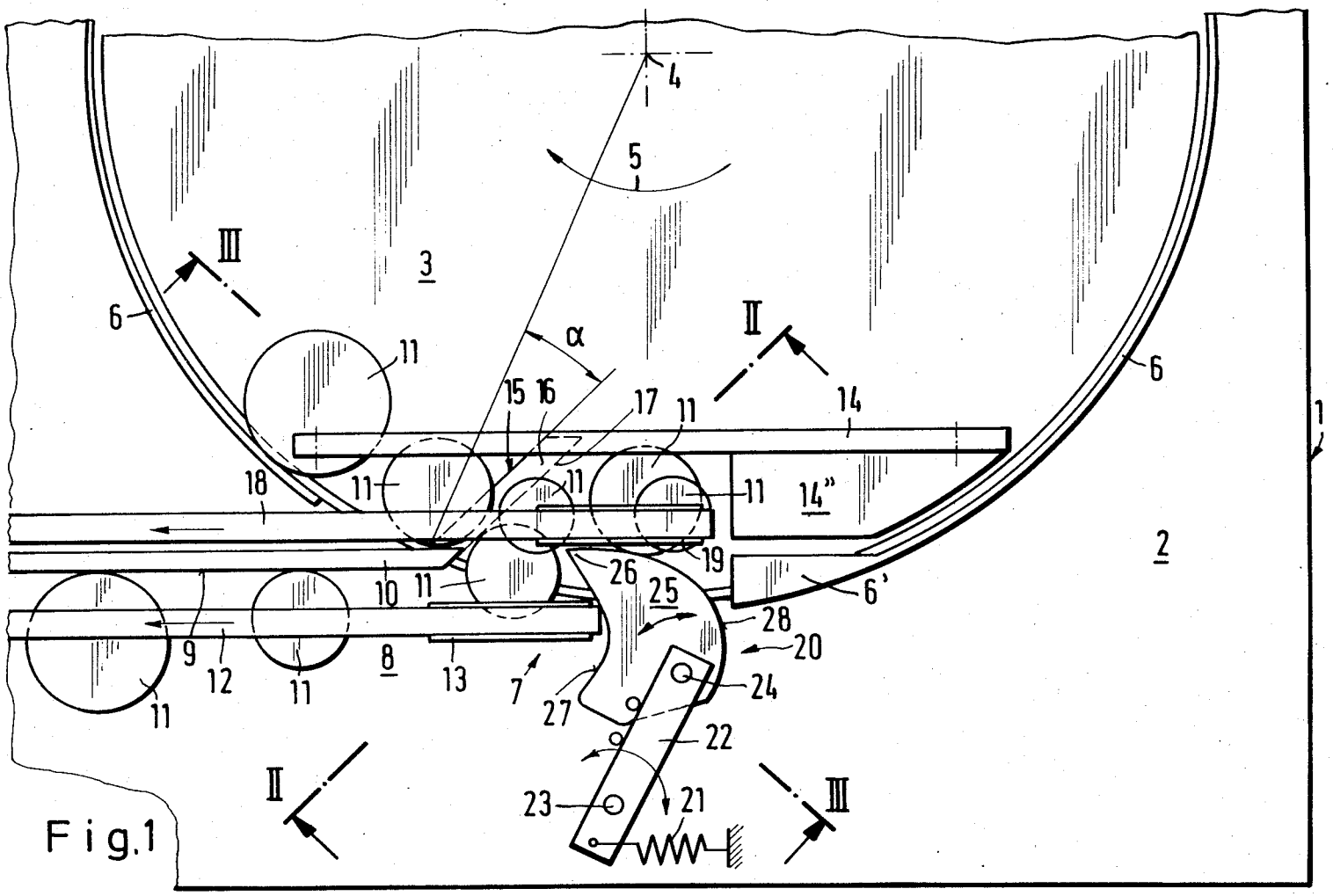
FIG. 1 is a top plan view of coin disc equipped with a guide finger at the entrance of the guideway.

The coin separating device comprises a frame 1 with a base plate 2 forming the top side. On the top side, a horizontal coin disc 3 having a vertical axis 4 extending perpendicularly to the drawing plane of FIG. 1, is mounted for rotation in the plane of base plate 2 in the direction of arrow 5, and is surrounded by a disc collar 6 which is firmly secured to base plate 2 and is interrupted by a recess in the zone of the entrance 7 of a guideway 8. A conveyor belt 12 trained, in the zone of entrance 7 into guideway 8, about a tail pulley 13 which is supported by a bracket (not shown) which is mounted for pivoting above base plate 2, extends along guideway 8, at a small angle relative to the guide edge 9 of a guide rail 10 for the coins 11.

Extending in front of entrance 7 to guideway 8 and above coin disc 3 is a coin stripping arm 14 which is adjustable in height but in fixed position during operation and has its lower edge 14' spaced from the surface of the coin disc 3 by a distance which slightly exceeds the thickness of the thickest coin 11. Coin stripping arm 14 extends substantially parallel to guideway 8. The arm comprises a guide sheet 14'' for forming a guide passage terminating close ahead of a coin guiding nose 6' which is flush with guide edge 9.

A second coin stripping arm 15 is provided between first coin stripping arm 14 and the entrance 7 to guideway 8. Second arm 15 is embodied by a narrow and thin guide finger 16 which is thinner than the thinnest coin 11. Preferably, guide finger 16 is about 1 mm thick. Guide finger 16 extends close above coin disc 3 and forms an extension of guide rail 10 of guideway 8. Guide finger 16 projects substantially radially above coin disc 3, but preferably at acute angle $\alpha$ relative to the radius of coin disc 3, angle $\alpha$ being the angle by which guide finger 16 is deflected from the radius toward entrance 7 of guideway 8. Guide finger 16 is firmly secured to guide rail 10 and its firm edge 17 blends directly into guide edge 9 for the coins 11. The free end of guide finger 16 protrudes to about below first coin stripping arm 14. Coin disc 3 rotates freely close below guide finger 16. Above guide finger 16, a second conveyor belt 18 is mounted extending substantially parallel to conveyor belt 12 which runs above guideway 8. Conveyor belt 18 is trained about a tail pulley 19 which is supported by a bracket (not shown) pivoted to base plate 2.

In entrance 7, opposite guide finger 16, a closing member 20 is provided for adjusting the width of entrance 7 to the diameter of coins 11. Closing member 20 comprises a lever arm 22 which is biased by a spring 21 and pivotable about a fixed pin 23, and a crescent-shaped closing element 25 mounted thereon for swinging about an axis 24.

The above described coin separating device operates as follows:

With coin disc 3 rotating in the direction of arrow 5 about axis 4, the coins 11 are guided in the direction of entrance 7 of guideway 8. Already by the first coin stripping arm 14 which is adjusted to have its lower edge 14' spaced from coin disc 3 by the thickness of the thickest coin, double coins having a total thickness exceeding that of the thickest coin are singled out. By double coin in this connection, two or three coins lying one on the other are understood having a total thickness smaller than the thickness of the thickest coin. Such double coins, after having passed first coin stripping arm 14, run against second coin stripping arm 15 which is formed by the narrow and thin guide finger 16. Along the front edge 17 of guide finger 16, the lowermost coins 11 of a double coin are deviated into entrance 7 of guideway 8, which is initially due to the centrifugal force of coin disc 3 and then effected by the lower section of conveyor belt 12. Not every one of the uppermost coins 11 which lie on the coin 11 resting on coin disc 3 can pass into entrance 7, since guide finger 16 is thinner than the thinnest coin. The uppermost coins 11 are pulled off over guide finger 16 by the lower section of second conveyor belt 18, and returned in the direction of rotation (arrow 5) to coin disc 3. In this way, an absolutely reliable separation from double coins takes place with the aid of simple, wear-resistant constructional parts, namely the guide finger 16 secured to guide rail 10 and freely projecting over coin disc 3, and the conveyor belt 18 extending above guide finger 16 and having its lower section straightened close above the surface of guide finger 16.

Figure 2:
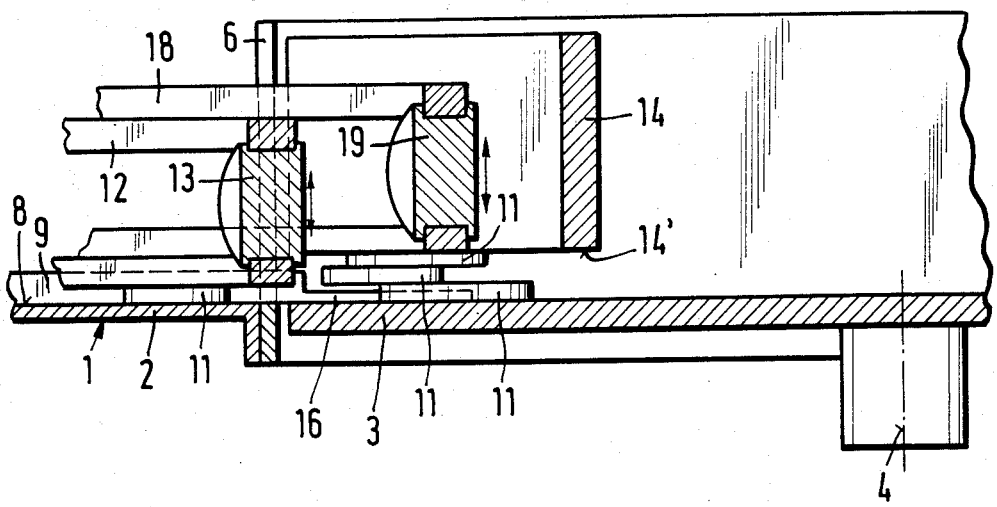
FIG. 2 is a sectional view taken along the line II—II of FIG. 1.
Figure 3:
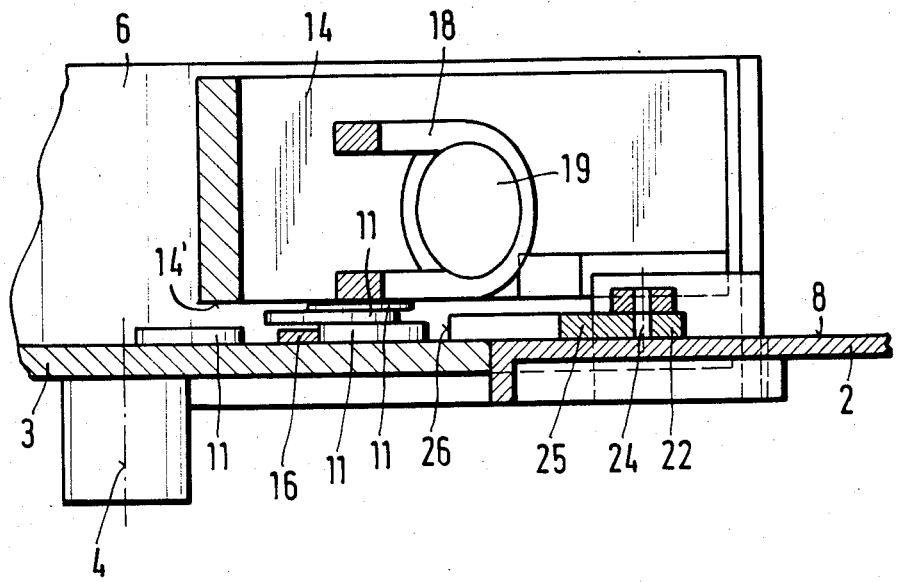
FIG. 3 is a sectional view taken along the line III—III of FIG. 1.

Both conveyor belt 12 and conveyor belt 18 running over guide finger 16 are resiliently mounted on a bracket (not shown) and can therefore adjust their spacing from the plane of guideway 8 or of coin disc 3 to the thickness of coins 11 or of a double coin with in the latter case the uppermost coin being pulled off the coin 11 which is guided along the front edge 17 of guide finger 16. The resilient movements of conveyor belts 12 and 18 are indicated in FIG. 2 by double arrows sidewards of tail pulleys 13 or 19.

Angle $\alpha$ formed between guide finger 16 and the radius coin disc 3 is between 20° and 30°.

Figure 4:
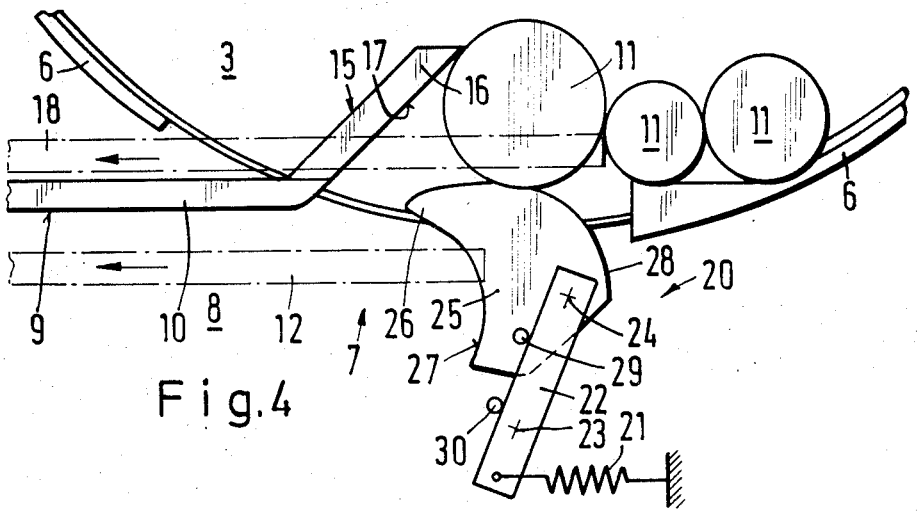
FIGS. 4, 5 and 6 are top plan views of the coin disc, the guide finger, and the guideway, with the closing element in the entrance of the guideway being shown in different positions.
Figure 5:
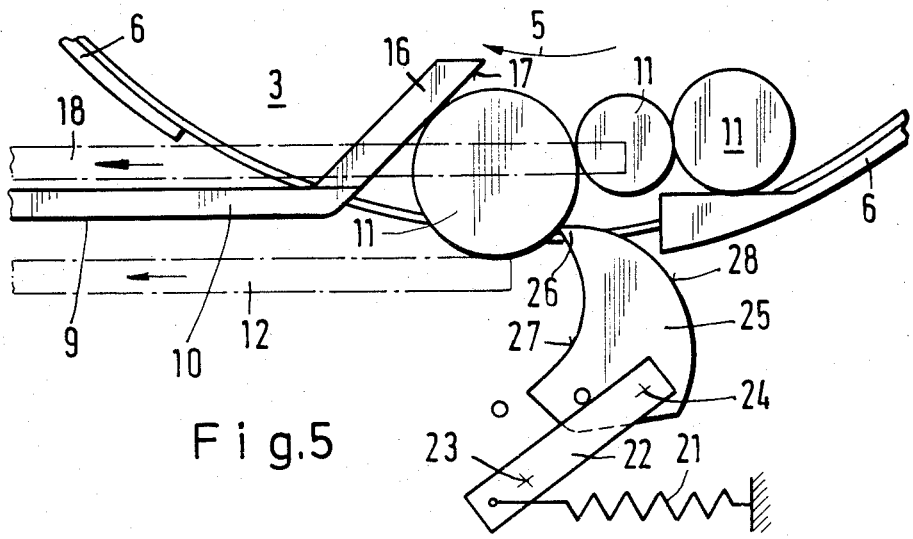
Figure 6:
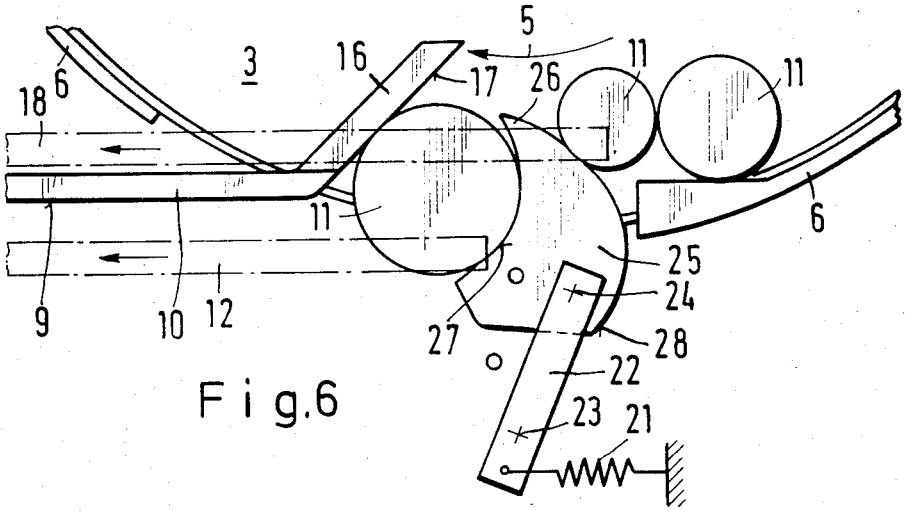

Guide finger 16 cooperates with closing element 25 in the way shown in FIGS. 4 to 6. Closing element 25 prevents a penetration of a plurality of smaller-diameter coins 11 into entrance 7 to guideway 8 immediately after a large-diameter coin. A larger-diameter coin 11 running along front edge 17 of guide finger 16 is capable of pivoting closing element 25 along with arm 22 clockwise, since element 25 applies against arm 22 by a stop 29, during which pivotal motion the arcuate, convex outside 28 of closing element 25 slides along the coin. As soon as the large-diameter coin 11 passes beyond tip 26 of closing element 25 (FIG. 5), element 25 snaps back under the action of tension spring 21 into its position shown in FIG. 6, in which the coin 11 is pressed by the crescent-shaped recess 27 against the front edge 17 of guide finger 16. Later arrived smaller-diameter coins 11 are deviated by the outside 28 of closing element 25 in the direction of guide finger 16. Tip 26 further prevents a simultaneous passage into entrance 7 of two smaller-diameter coins which might slip therethrough after the large-diameter coin. In this regard closing elemet 25 whose arm 22 applies in rest position (FIG. 4) against a fixed stop 30, cooperates in an extraordinarily satisfactory way with guide finger 16.

I claim:

1. A device for separating single coins from a collection of coins including coins having a thickest thickness and coins having a thinnest thickness with the coins redirected from a coin disc through an adjoining substantially tangential horizontal guideway which is provided with a conveyor belt for the coins, comprising a first coin stripping arm which is disposed above the coin disc a distance slightly more than the thickness of the thickest coins, in front of the entrance into the guideway, and a second coin stripping arm which is disposed in a path of motion of the coins after the first stripping arm and extends substantially radially relative to the coin disc, characterized in that the second coin stripping arm (15) is designed as a thin guide finger (16) which is at most as thick as the thinnest coins and disposed closely above the coin disc (3) after the entrance (7) into the guideway (8) considered in a direction of rotation of the coin disc (3), and that a second conveyor belt (18) extends above the guide finger (16) and is arranged for conveying away from the entrance (7) and back onto the coin disc (3) any overlying coins disposed on a coin on the coin disc (3) which is being guided by the guide finger (16) into the entrance (7).

2. A device for separating single coins according to claim 1, characterized in that the thickness of the guide finger (16) is smaller than the thickness of the thinnest coin.

3. A device for separating single coins according to claims 1, characterized in that the thickness of the guide finger (16) is about 1 mm.

4. A device for separating single coins, according to claim 1, characterized in that the guide finger (16) extends at an acute angle ($\alpha$) relative to the radius of the coin disc (3), in the direction of the entrance (7).

5. A device for separating single coins according to claim 1, characterized in that the guide finger (16) is designed as an angled extension of the guide rail (10).

6. A device for separating single coins according to claim 1, characterized in that a crescent-shaped closing element (25) is mounted in the entrance into the guideway (8) opposite the guide finger (16), which closing element is hinged to a spring-biased pivotal lever (22).

7. A device for separating coins singly from a collection of coins including coins having a thickest thickness and coins having a thinnest thickness comprising:

a coin disc having a top surface and an outer circumference and being rotatable in a coin sorting direction, collar means associated with said disc for confining coins to said top surface said collar means having an exit for releasing coins from said top surface over said outer circumference, guideway means defining a substantially horizontal guideway extending substantially tangentially to said outer circumference and having an entrance for receiving coins from said exit from said collar means, first conveyor means associated with said guideway means for conveying coins from said entrance along said guideway, a first coin stripping arm disposed above said top surface near said exit of said collar means, said first coin stripping arm having a lower edge spaced above said top surface by slightly more than the thickness of said thickest coins for passing coins having at most said thickest thickness under said lower edge with rotation of said coin disc, a second coin stripping arm disposed over said top surface adjacent said exit and between said first coin stripping arm and said entrance of said guideway, said second coin stripping arm having a thin guide finger which is at most as thick as the thickness of said thinnest coins, said thin guide finger extending directly above said coin disc and about radially with respect to said coin disc, said thin guide finger being disposed just above said top surface for guiding coins on said top surface into said entrance of said guideway, and second conveyor means associated with said second coin stripping arm and arranged for conveying away from said entrance and back onto said top surface any overlying coins disposed on a coin on said top surface which is being guided by said thin guide finger into said entrance of said guideway.

8. A device according to claim 7, wherein said first and second conveyor means comprise first and second conveyor belts which are mounted for resilient movement toward and away from a plane of said top surface.

9. A device according to claim 8, wherein said thin guide finger has a thickness of about 1 mm.

10. A device according to claim 7, wherein said guide finger extends at an acute angle to a radius of said coin disc in a direction toward said entrance from said outer circumference of said coin disc.

11. A device according to claim 7, wherein said guideway means includes a guiderail, said thin guide finger connected to and extending from said guiderail at an angle to said guiderail.

12. A device for separating coins singly a collection of coins including coins having a thickest thickness and coins having a thinnest thickness comprising:

a coin disc having a top surface and an outer circumference and being rotatable in a coin sorting direction, collar means associated with said disc for confining coins to top surface said collar means having an exit for releasing coins from said top surface over said outer circumference, guideway means defining a substantially horizontal guideway extending substantially tangentially to said outer circumference and having an entrance for receiving coins from said exit from said collar means, first conveyor means associated with said guideway means for conveying coins from said entrance along said guideway, a first coin stripping arm disposed above said top surface near said exit of said collar means said first coin stripping arm having a lower edge spaced above said top surface by slightly more than the thickness of said thickest coins for passing coins having at most said thickest thickness under said lower edge with rotation of said coin disc, a second coin stripping arm disposed over said top surface adjacent said exit and between said first coin stripping arm and said entrance of said guideway, said second coin stripping arm having a thin guide finger which is at most as thick as the thickness of said thinnest coins, said thin guide finger extending directly above said coin disc and about radially with respect to said coin disc, said thin guide finger being disposed just above said top surface for guiding coins on said top surface into said entrance of said guideway, and second conveyor means associated with said second coin stripping arm and arranged for conveying away from said entrance and back onto said top surface any overlying coins disposed on a coin on said top surface which is being guided by said thin guide finger into said entrance of said guideway, and further including a crescent-shaped closing element mounted for rotation into and out of said exit of said collar means for regulating a passage of coins from said exit into said entrance of said guideway means, and biasing means connected to said crescent-shaped closing element for rotating said closing element in a direction closing said exit, said crescent-shaped closing element having a surface engageable by coins for moving said crescent-shaped closing element against a bias against said biasing means to open said exit.

* * * * *